United States Patent [19]

Jones

[11] Patent Number: 4,989,859

[45] Date of Patent: Feb. 5, 1991

[54] METHOD FOR TESTING AND/OR EXERCISING THE ROTARY NECK MUSCLES OF THE HUMAN BODY

[76] Inventor: Arthur A. Jones, 1155 NE. 77th St., Ocala, Fla. 32670

[21] Appl. No.: 307,706

[22] Filed: Feb. 8, 1989

Related U.S. Application Data

[63] Continuation-in-part of Ser. No. 60,679, Jun. 11, 1987, Pat. No. 4,836,536, and a continuation-in-part of Ser. No. 236,367, Aug. 25, 1988, Pat. No. 4,902,009, and a continuation-in-part of Ser. No. 181,372, Apr. 14, 1988, Pat. No. 4,834,365.

[51] Int. Cl.[5] ..... A63B 23/025; A63B 21/062

[52] U.S. Cl. ..... 272/94; 272/118; 272/134; 128/25 R; 73/379

[58] Field of Search ..... 272/93, 94, 96, 117, 272/118, 134, 128, 129; 128/25 R; 73/379

[56] References Cited

U.S. PATENT DOCUMENTS

| | | | |
|---|---|---|---|
| 3,465,592 | 9/1969 | Perrine | 73/379 |
| 4,104,918 | 8/1978 | Macoveano et al. | 73/379 |
| 4,278,249 | 7/1981 | Forrest | 272/94 |
| 4,515,363 | 5/1985 | Schleffendorf | 272/118 |
| 4,569,518 | 2/1986 | Fulks | 272/129 |
| 4,653,750 | 3/1987 | McIntyre | 272/134 |
| 4,673,180 | 6/1987 | Rice | 272/128 X |
| 4,727,860 | 3/1988 | McIntyre | 272/134 X |
| 4,733,859 | 3/1988 | Kock et al. | 272/94 X |
| 4,763,897 | 8/1988 | Yakata | 272/134 X |
| 4,768,779 | 9/1988 | Oehman, Jr. et al. | 272/94 |

OTHER PUBLICATIONS

The "4-Way Neck Machine", In the Nautilus Instruction Manual, 6-1979, 272/94, Advertisement for "The Roughneck", In Coach & Athlete, 11-1981, p. 27, 272/94.

*Primary Examiner*—Robert Bahr

*Attorney, Agent, or Firm*—William E. Mouzavires

[57] ABSTRACT

Method for testing and/or exercising the rotary neck muscles which are used to twist or turn the neck from side-to-side about a generally vertical pivot axis passing through the cervical vertebrae. The head is held by and between a pair of pads mounted on a rotatable frame fixed to a movement arm in the form of a vertical pivot shaft rotatable about the pivot axis. The movement arm is connectable to a resistance weight stack to oppose pivotal movement of the movement arm in one direction. During exercise, the subject is seated against a backrest with a front pad assembly immobilizing the chest and shoulder areas of the subject. Additionally, the head pads prevent forward and rearward movement of the neck in extension and flexion so that only the rotary torsion muscles of the neck are exercised.

2 Claims, 6 Drawing Sheets

METHOD FOR TESTING AND/OR EXERCISING THE ROTARY NECK MUSCLES OF THE HUMAN BODY

RELATED APPLICATIONS

The present application is a continuation-in-part of my following copending U.S. Pat. applications: Ser. No. 07/060,679, filed June 11, 1987 and entitled "Method And Apparatus For Testing Or Exercising Muscles Of The Lower Trunk Of The Human Body" now U.S. Pat. No. 4,836,536; Ser. No. 07/236,367, filed Aug. 25, 1988, entitled "Machine For Exercising And-/Or Testing Muscles Of The Lower Trunk And Method" now U.S. Pat. No. 4,902,009; and Ser. No. 07/181,372, filed Apr. 14, 1988, entitled "Compound Weight System" now U.S. Pat. No. 4,834,365.

BACKGROUND OF INVENTION

Apparatus for exercising the rotary neck muscles of the human body exist in the prior art as evidenced by U.S. Pat. Nos. 4,278,249 to Forrest and 4,655,450 to Rogers et al. Such apparatus include head pads which engage the opposite sides of the head while being movable about a vertical axis in response to exertions of the rotary neck muscles to twist or rotate the head from side-to-side. However, such apparatus have no provision for isolating the rotary neck muscles from the torso of the subject which is thus free to assist the rotary neck muscles in performing an exercise thereby lessening efficiency or the effect of the exercise on the rotary neck muscles per se. Moreover, any measurements taken of the strength of the rotary neck muscles may be inaccurate or misleading due to the inclusion of forces generated by the torso.

OBJECTS OF THE PRESENT INVENTION

The present invention relates to novel methods and apparatus for testing and/or exercising the rotary muscles of the neck of a human body which muscles serve to rotate the head and neck.

An object of the present invention is to provide novel and improved methods and apparatus for testing and/or exercising the rotary muscles of the human neck. Included herein are such methods and apparatus which are safe and effective to provide accurate and controlled testing and/or exercise of the rotary neck muscles with minimal risk of injury to the neck.

Another object of the present invention is to provide such methods and apparatus which isolate the rotary neck muscles from the torso of the subject so that only the rotary neck muscles are tested and/or exercised.

Another object of the present invention is to provide such apparatus that may be used to conduct static or dynamic tests or exercise of the rotary neck muscles and that allow accurate measurement of the results thereof.

A still further object of the present invention is to provide such methods and apparatus that may be easily conducted or operated without special skills and with a maximum of safety to the neck muscles.

SUMMARY OF INVENTION

In accordance with preferred methods and apparatus of the present invention, a subject is seated and secured against a backrest with the chest and shoulders secured against the backrest against movement. A pair of head pads fixed to a movement arm are engaged against opposite sides of the subject's head to hold the head in a horizontal position. Starting from an extreme side position where the head faces towards one side, the subject rotates his head in torsion towards the opposite side against a resistance weight connected to the movement arm causing the resistance weight to be lifted as a result of positive work performed by the rotary neck muscles. After reaching the opposite side, the head is rotated back towards the starting position while the resistance weight is lowered through negative work performed by the neck muscles. The aforementioned exercise is then repeated until the subject is no longer able to perform positive work. The magnitude of the resistance weight is safely less than the static strength of the rotary neck muscles, and the stroke of the resistance weight is limited to minimize kinetic energy of the weight so as to avoid any risk of injury to the muscles.

To test the static strength of the rotary neck muscles, the movement arm including the head pads is fixed against movement in a plurality of different angular positions, and in each position, the subject exerts a torsional force against the head pads and the magnitude of the force is measured and recorded at each position.

DRAWINGS

Other object and advantages of the present invention will become apparent from the detailed description below taken in conjunction with the accompanying drawings in which.

DETAILED DESCRIPTION

Figure 1:
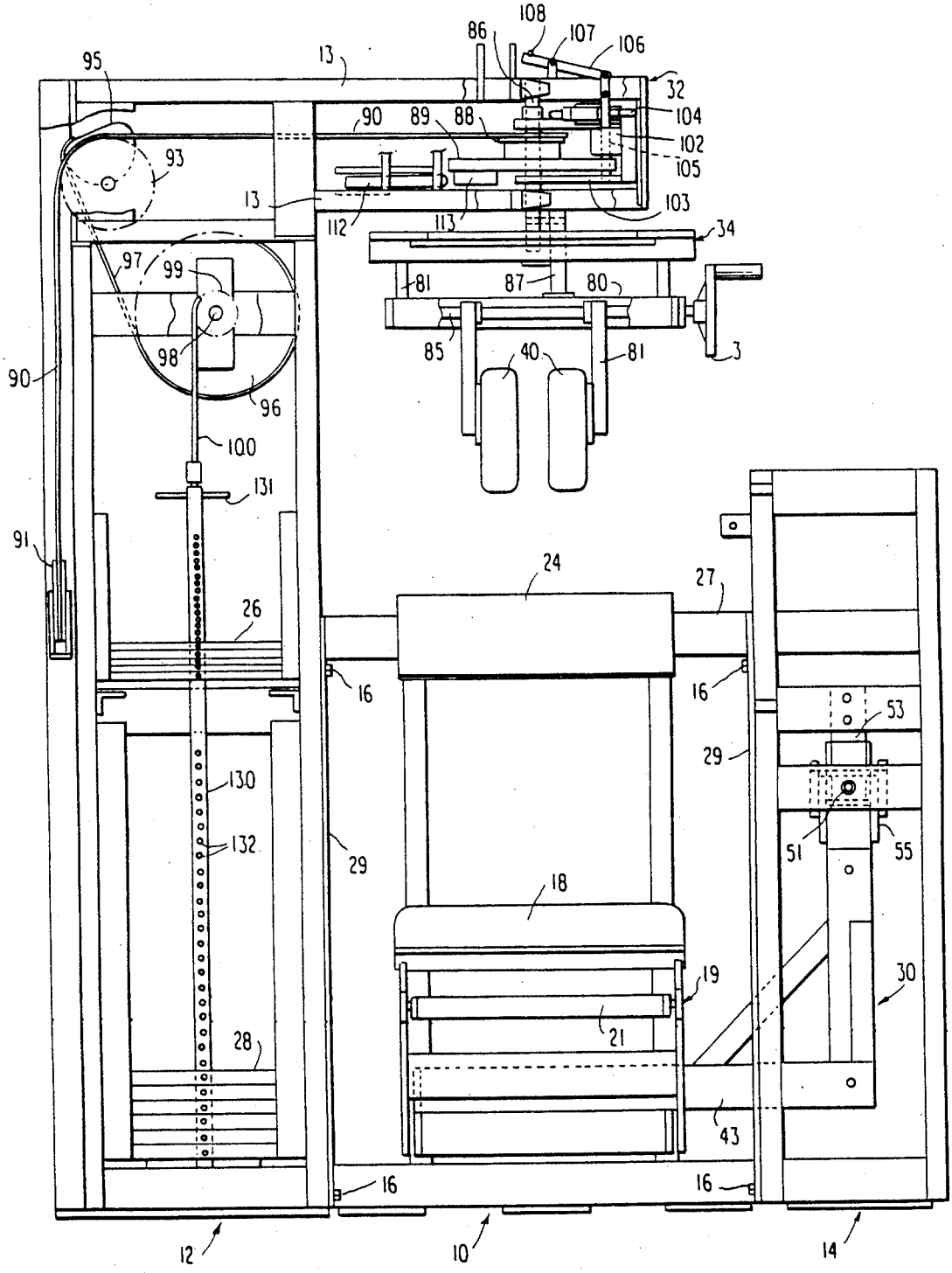
FIG. 1 is a front elevational view of apparatus constituting a preferred embodiment of the present invention and shown with certain parts omitted for purposes of clarity.

Referring to the drawings in detail, there is shown, for illustrative purposes only, a preferred embodiment of apparatus embodying the invention for testing and-/or exercising the rotary muscles of the neck in accordance with preferred methods of the present invention.

BASIC FRAMEWORK

Figure 3:
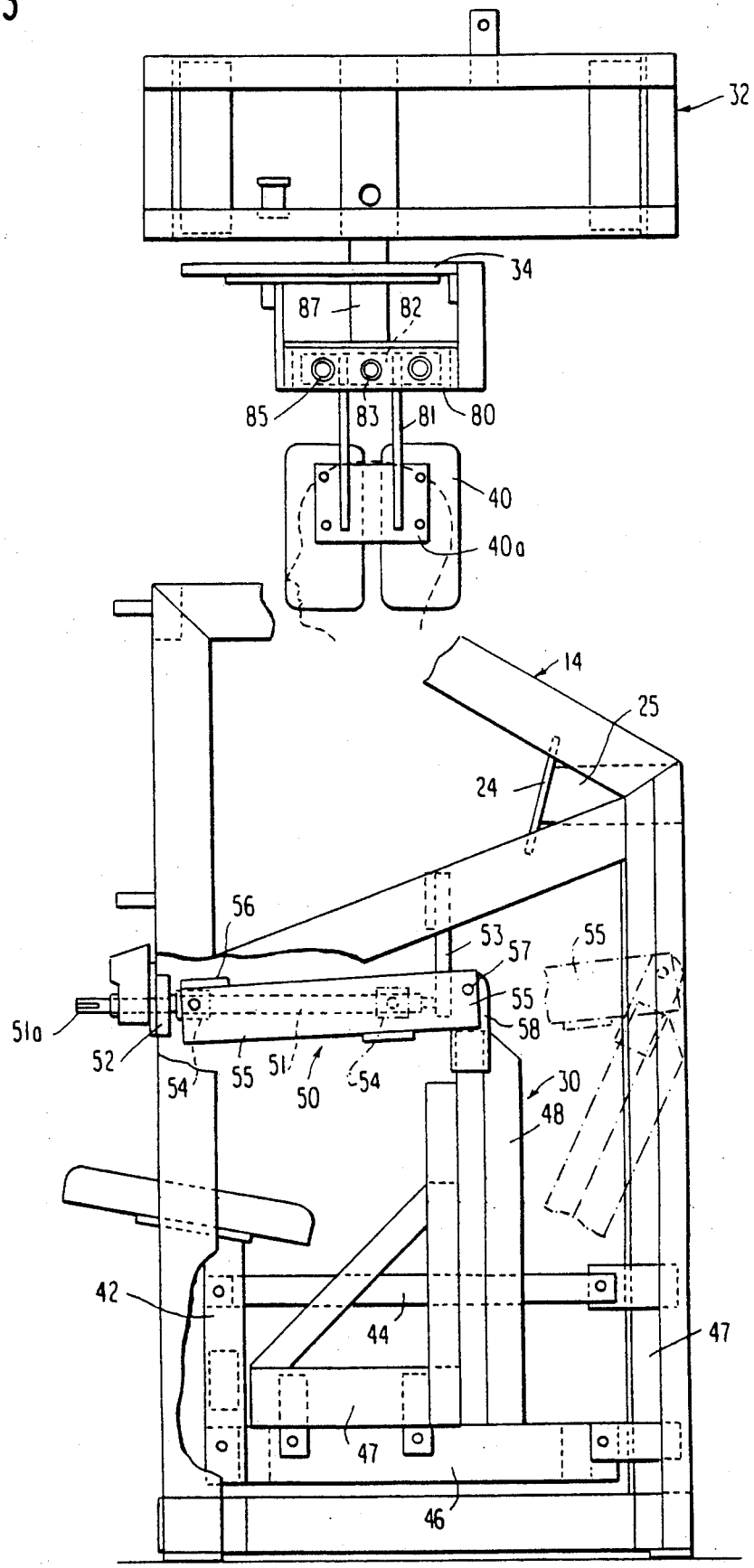
FIG. 3 is a side elevational view of the apparatus as seen from the left-hand side thereof and with certain parts omitted.

Referring initially to FIG. 1, the apparatus includes a center frame generally designated 10 and right and left hand frames generally designated 12 and 14, respectively, fixed to the center frame at locations such as indicated at 16. Center frame 10 supports a seat 18 and a fixed backrest 20, the seat 18 being attached to a mounting plate 22 and the backrest being attached to a fixed mounting plate 24 shown in FIG. 1 with the backrest 20 omitted. The backrest mounting plate 24 is fixed by arms 25 which are fixed to a cross frame piece 27 fixed between a pair of vertical frame members 29 at the rear of the center frame as shown in FIGS. 1 and 3. Seat 18 is supported on a linkage generally designated 19 which is movable to adjust the elevation of the seat 18.

The left-hand frame 14 is used to support a cantilever support beam structure generally designated 30 for supporting and actuating the seat 18 through linkage 19 which allows the elevation of seat 18 to be adjusted as will be described below.

The right hand frame 12 supports a compound weight stack including independent stacks of upper and lower weights 26 and 28 used to provide resistance to the rotary neck muscles during exercise as will be described. The right-hand frame 12 is also used to support a head pad frame generally 34 through means of a frame generally designated 32 cantilevered from the top of the right-hand frame 12 as shown in FIG. 1 with the head pad frame 34 suspended from the cantilevered frame 32 as will be further described. Head frame 34 includes a pair of opposed head pads 40 engageable with the opposite sides of the subject's head.

THE SEAT LINKAGE

Referring to FIGS. 1 and 3, seat 18 is supported on a linkage including on each side of the seat, a vertical link 42 and a pair of generally parallel and horizontal links 44 and 46 pivotally connected at their forward ends to vertical link 42 and at their rear ends to a vertical frame member 47 as shown in FIG. 3. The linkages on each side of the seat are integrated by a cross link 21. Vertical link 42 is fixed at its top to seat mounting plate 22 so that actuation of the linkage will raise or lower seat 18 while vertical link remains in a vertical plane.

Seat linkage 42, 44 and 46 is suspended and actuated by the cantilever beam generally designated 30 which includes parallel horizontal beams 43 fixed to the seat link 46 and joined at their ends by a cross beam 47. The cantilever beam further includes a vertical composite beam 48 fixed at its bottom to horizontal and cross beams 43 and 47.

Cantilever beam 30 is adapted to be rocked between the full line and dotted line positions shown in FIG. 3 by an actuating mechanism generally designated 50 including a screw rod 51 having its opposite ends mounted for rotation in frame support members 52 and 53. Mounted on rod 51 for movement along rod 51 is a nut 54 which is pivotally connected to an actuating arm formed by a pair of elongated plates 55 joined by a cross member 56. The rear ends of plates 55 are pivotally connected by pin 57 to an ear 58 fixed to the top of cantilever beam 30. Rotation of screw rod 51 will move the plates 55 forwardly or rearwardly depending on the direction of rotation to rock the cantilever beam 30. Rod 51 is actuated through a handwheel (not shown) fixed to the forward end 51*a* of the rod 51. The rearmost portions of the nut 54 and plates 55 are shown in dotted lines in FIG. 3.

FRONT PAD ASSEMBLY

Figure 2:
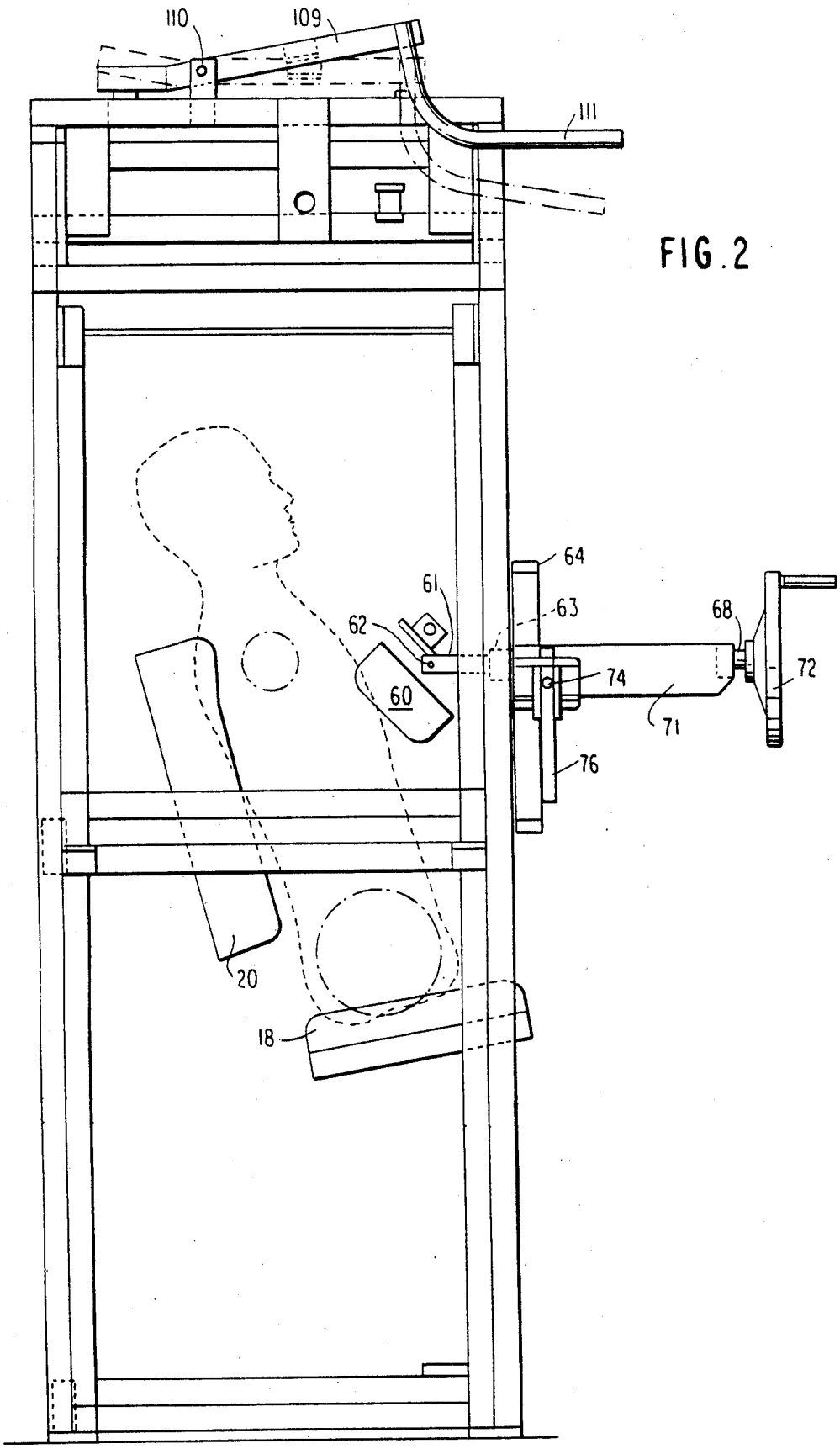
FIG. 2 is a side elevational view of the apparatus as seen from the right-hand side thereof and with a subject partially shown seated in the apparatus and with certain parts of the apparatus omitted.
Figure 4:
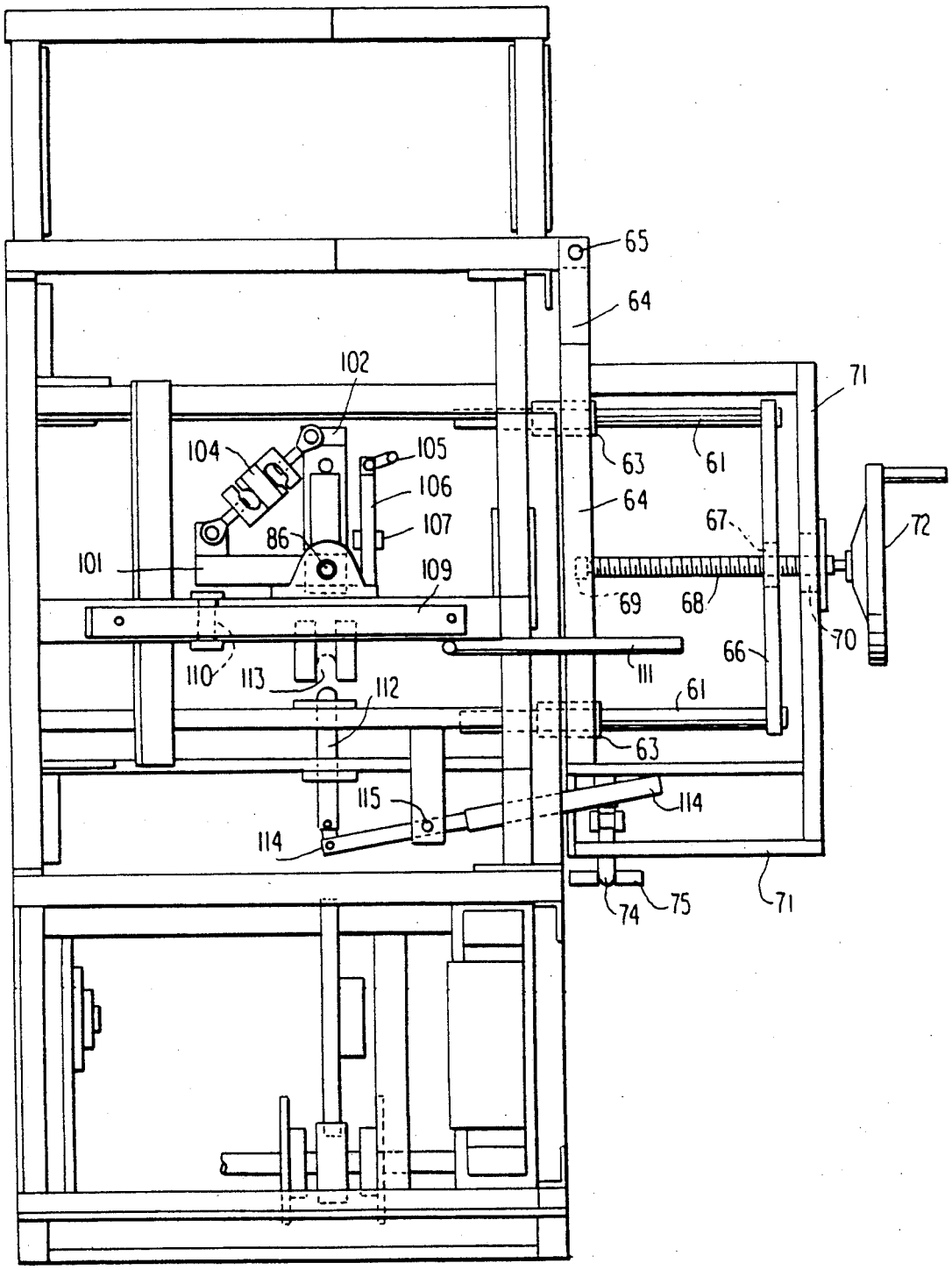
FIG. 4 is a plan view of the apparatus with certain parts omitted.

Referring to FIGS. 2 and 4, a plurality of front pads, preferably two pads 60, are mounted to the frame to be engageable with the chest and shoulders of the subject to immobilize the upper torso below the neck. Pads 60 are mounted on rods 61 for pivotal adjusting movement about pivot pins 62 shown in FIG. 2. Rods 61 are mounted for slidable and rotatable movement in bushings 63 fixed in a generally rectangular frame 64 hinged at one side by pins 65 to the left-hand side frame 14. The forward ends of rods 61 are interconnected by a yoke 66 having a nut 67 rotatably mounted on an actuating screw rod 68 having one end 69 rotatably mounted in frame 64 and an opposite end portion 70 rotatably mounted in a frame 71 where it is held against longitudinal movement. Frame 71 is fixed to the hinged frame 64 to be movable therewith. A handwheel 72 is fixed to rod 68 such that rotation of the rod 68 in one direction will advance the pads 60 and in the opposite direction will retract the pads 60 by virtue of the slide rods 61 moving in bushings 63. Access to the seat 18 is achieved by swinging frame 64 about hinge pins 65 such that the entire front pad assembly will move with frame 64 into the open position. The closed position shown in FIG. 4, of the assembly is determined and secured by a latch assembly including a latch pin 74 slidably mounted in frame 71 to be received in a keeper 75 fixed to the main frame. A handle 76 for moving latch pin 74 is fixed to the latch pin as shown in FIG. 2. The front pads may be extended horizontally to engage the chest and shoulder areas and may be rotated about the longitudinal axes of the rods as well as the transverse axis 62 to allow adjustment to the particular subject.

HEAD PAD ASSEMBLY

Referring to FIGS. 1 and 3, the head pad assembly includes a generally rectangular frame 34 and a secondary frame 80 suspended from frame 34 by vertical members 81 fixed to both frames 34, 80. In the shown embodiment, each side of the pad assembly includes a pair of pads 40 fixed to mounting plate 40*a* which is suspended from frame 80 by arms 81 fixed at their lower ends to mounting plate 40*a* and at their upper ends to a yoke 82 having a nut received about an actuating screw rod 83 mounted for rotation only, in frame 80. Yoke 82 is guided for movement along screw rod 83 by guide rods 84 received through the yokes and being mounted in the frame 80 in parallel to rod 83. Screw rod 83 has opposite threads on the left and right hand sections thereof such that upon rotation of rod 83 by handwheel 3 (FIG. 1), the opposing pads 40 will move towards or away from each other.

The pad frames 34 and 80 are adapted to be rotated together as a unit about a vertical axis in response to forces generated by the rotary muscles of the neck as transmitted through the head pads 40 when the subject turns or twists his head from one side to the other. This is effected by fixing the frames 34, 80 for rotation with a movement arm in the form of a vertical pivot shaft 86 about a vertical axis. The latter is accomplished by a vertical member 87 fixed to shaft 86 and to frames 34 and 80 as shown in FIG. 1. Shaft 86 is mounted for rotation in suitable bearings provided in a generally rectangular frame 32 which is cantilevered from the top of right side frame 12 to overly frame 34 by horizontal frame beams 13 shown in FIG. 10. In use, pads 40 are adjusted to sufficiently grip the opposite sides of the head to allow direct transfer of torsional forces from the neck to the pads, and also to maintain the head in a horizontal plane.

TRANSMISSION BETWEEN HEAD PAD ASSEMBLY AND RESISTANCE WEIGHT

Figure 6:
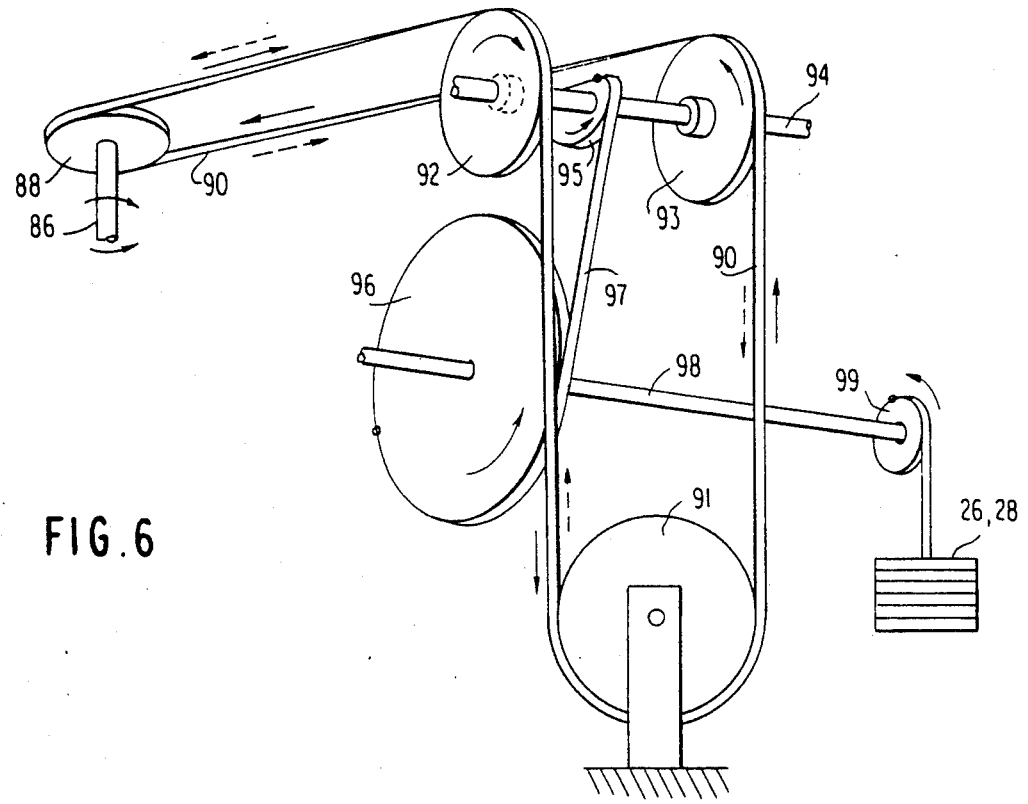
FIG. 6 is a schematic view of a pulley drive train for operating a resistance weight stack included in the apparatus.

Referring to FIGS. 1 and 6, rotation of the head pad assembly by a subject during an exercise is opposed by one or more resistance weights 26 and 28. To this end, the movement arm shaft 86 is releasably connected to the resistance weight by means of a sprocket and pulley system including a sprocket 88 fixed to a disc 89 and both being mounted for rotation about shaft 86. A pulley chain 90 is trained at one end about sprocket 88 and at the other end over sprocket 91 while changing direction at intermediate sprockets 92 and 93 fixed on shaft 94. Sprockets 92 and 93 each have in their hubs one-way clutches permitting them to engage the shaft 94 to drive the same only when the sprocket is moved in one direction. Between sprockets 92 and 93, a cam 95 is fixed to shaft 94 and is connected to a sprocket 96 by a chain 97. Sprocket 96 is fixed on shaft 98 which has fixed thereto a sprocket 99 connected to the weight stack by a chain 100. It will be seen that when pivot shaft 86 of the head pad assembly is connected to sprocket 88 as will be described, rotation of shaft 86 in either direction by application of forces through the head pads 40 will cause either sprocket 92 or 93 to rotate the shaft 94 while the other sprocket is not drivingly engaged to shaft 94. Cam 95 will rotate with the shaft to drive sprocket 96 and, in turn, shaft 98 and sprocket 99 to lift the resistance weight.

Figure 7:
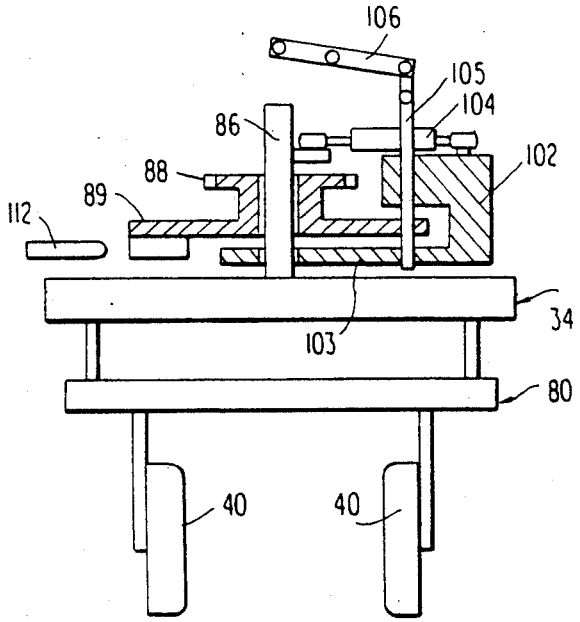
FIG. 7 is a fragmental front elevational view of a front pad assembly included in the apparatus and with portions shown in cross section.

Referring to FIGS. 1, 4 and 7, in order to connect the pivot shaft 86 to the resistance weight, pivot shaft 86 is provided with an arm 101 connected to a vertical keeper arm 102 fixed to a horizontal keeper plate 103 mounted for rotation about pivot shaft 86 below disc 89. This connection is preferably made by a strain gauge 104 as best shown in FIG. 4. Sprocket disc 89 is provided with a plurality of apertures angularly spaced about the sprocket discs for receiving a pin 105 which is also received in the keeper arm 102 and plate 103 to thus connect the pivot shaft 86 to the sprocket disc 89. The particular aperture selected in sprocket disc 103 will determine the starting angle of orientation of the had pads 40 relative to the pivot shaft 86.

Actuation of sprocket pin 105 into or out of the sprocket disc apertures is achieved by a lever 106 fulcrummed at a pivot 107 with one end pivotally connected to pin 105 and the other end engaged at 108 under an actuating lever 109 shown in FIGS. 2 and 4. Lever 109 is fulcrummed at 110 to be pivoted downwardly by a handle 111 to depress pin lever 107 at its end 108 to raise sprocket pin 105 to remove it from the selected aperture in sprocket disc 89. With the pin 105 thus removed from disc 89, the head pad assembly may be angularly adjusted about the vertical axis of the pivot shaft 86 which rotates with the head pad assembly during such adjustment. Once the desired position is achieved, the lever handle 111 is released and a spring will raise the actuating lever 109 which, in turn, will cause the pin 105 to be depressed into one of the selected apertures of the locking disc 89.

In order to fix the sprocket disc 89 during adjustment of the head pad assembly, a locking pin is slidably mounted in the frame to be received in a keeper 113 fixed to the underside of disc 89 as shown in FIGS. 1 and 4. Locking pin 112 is actuated by a lever 114 fulcrummed at 115 and connected at one end to locking pin 112 to insert the pin 112 in keeper 113 when pivoted clockwise as viewed in FIG. 4 and to remove the pin when pivoted counterclockwise. Fixation of the sprocket disc 89 by locking pin 112 is also used to fix the pivot shaft 86 during a static strength test to be described below.

Figure 5:
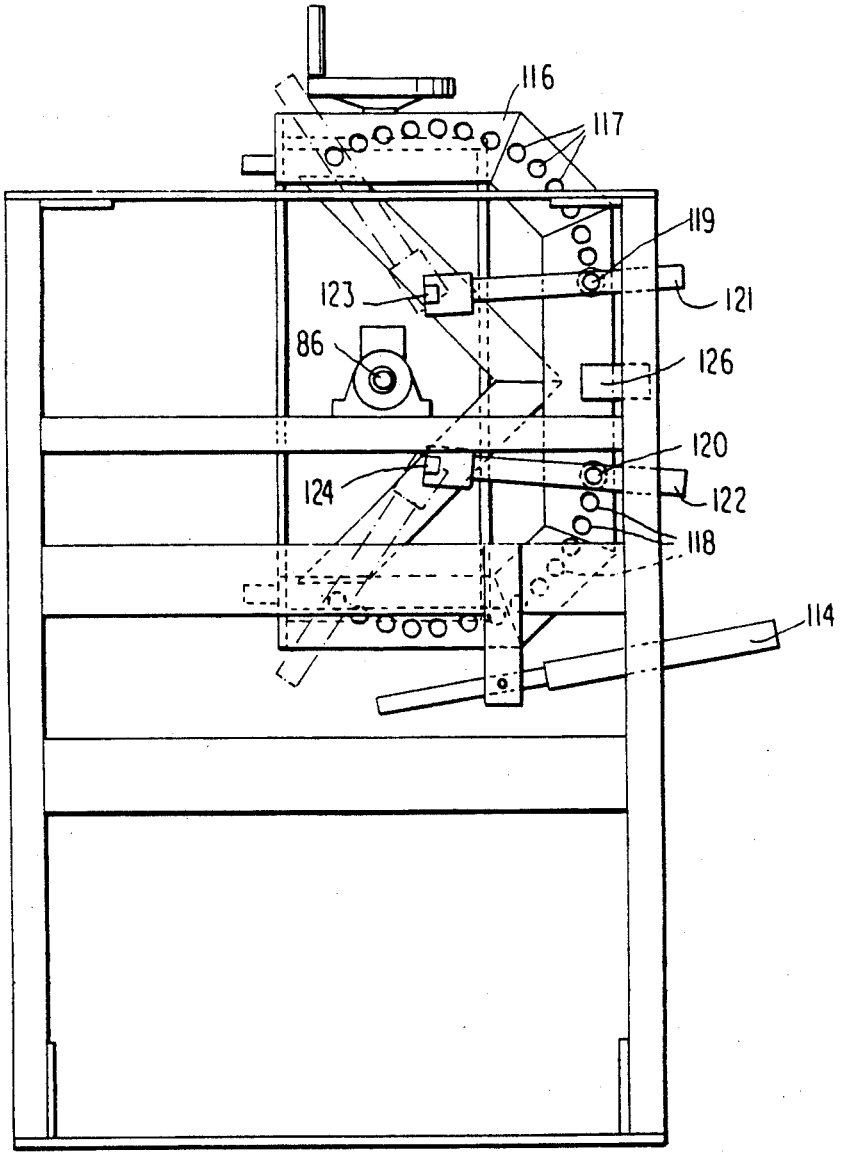
FIG. 5 is a plan view of a portion of the apparatus.

In the preferred embodiment, an adjustable stop mechanism is provided to define and limit the range of rotational movement of the head pad assembly during an exercise. Referring to FIG. 5, one such mechanism is shown including a plate 116 having first and second sets of apertures 117 and 118 adapted to receive lugs 119, 120 on levers 121 and 122 respectively. Levers 121 and 122 are pivoted with universal movement at pivots 123, 124 to allow the lugs 119, 120 to be removed from any aperture 117 and 118 and reinserted into an other aperture 117 and 118. The apertured plate 86 is rotatable with the pivot shaft 86, and a fixed stop 126 is provided by fixation to the staionary frame to engage one of the levers 121 or 122 depending on the direction of rotation to limit the rotation of the head pad assembly.

RESISTANCE WEIGHT STACK

Referring to FIG. 1, the resistance weight stack in the preferred embodiment is a compound weight stack which allows dead weights from either stack 26 or 28 or both stacks to be connected to the movement arm to provide the desired resistance to rotation of the pivot shaft 86 by the rotary neck muscles. The weights 26 of the upper stack are each less in magnitude than the weights 28 of the lower stack allowing a wide range of precise weight selection. In the preferred embodiment, weights 26 are each one pound and weights 28 are each twenty pounds. To attach the weights to a vertical connecting rod 130, a pair of keys, one being shown at 131, are provided to be insertable in apertures in the weight plates and in the connecting rod, the latter apertures being shown at 132. The top of the connecting rod 130 is connected to chain 100 of sprocket 99 so that rotation of the sprocket 99 in the clockwise direction shown in FIG. 1 will lift the connecting rod 130 and any weights attached thereto. Having lifted the weights with the force of the rotary neck muscles performing positive work, the subject will then return his head towards the starting position in the performance of negative work allowing the weights to descend by gravity. The system is designed so that the stroke of the weights is exceedingly short, on the order of one and one-half inches (1½) to prevent the weights from generating any significant kinetic energy that could risk injury to the neck muscles during the return stroke.

A more detailed description of a compound weight stack may be found in my above-identified copending application Ser. No. 07/181,372 whose disclosure is hereby incorporated by reference into the present application. A more detailed description of the seat linkage and front pad assembly described above may be found in my above-identified related application filed concurrently herewith.

SUMMARY OF OPERATION

To summarize operation of the apparatus in accordance with the method of the present invention, the subject is seated against the backrest and the elevation of seat 18 is adjusted by rotation of screw rod 51 until the subject's head is at the proper elevation between the head pads 40 as shown in FIG. 3 with the head pads 40 being in fully retracted or spaced apart position. A shoulder harness (not shown) is preferably applied across the front torso to secure the subject against the backrest 20. A seat belt (not shown) may also be applied to secure the subject on the seat 18. The front pad assembly is then swung to closed position and latched therein by means of latch pin 74. The handwheel 72 is then operated to advance the front pads 60 against the chest and shoulders to prevent movement of the upper torso. The subject is then asked to rotate his head from side-to-side to determine the range of movement and one of the stop levers 121 or 122 (FIG. 5) is positioned in accordance with the range of movement. The starting position of the head pad assembly is selected by removing the pin 105 from sprocket disc 89 by depressing lever 111 and rotating the head pad assembly to the desired position while the disc 89 is locked by pin 112. Once the desired position is achieved, the lever 111 is raised to insert sprocket pin 105 into the appropriate aperture in the sprocket disc 89. The head is rotated to one side into the starting position and the head pads 40 are extended by rotation of handwheel 3 to engage the opposite sides of the head while in a horizontal plane as shown in FIG. 3. An appropriate resistance weight safely less then the static strength of the rotary neck muscles, is selected from the compound weight stack plates 26, 28 and keyed to the connecting rod 100. The locking pin 112 is withdrawn from sprocket disc 89 by pivoting lever 114 clockwise as shown in FIG. 4.

The exercise commences with the subject's head positioned to one side in an extreme position depending on the subject's range of movement. The subject then exerts with his rotary neck muscles a force to turn his head gradually, smoothly and slowly towards the other side from the starting position causing the pivot shaft 86 and the sprocket 88 to rotate which, in turn, through the pulley system, causes the resistance weights to be lifted. In this phase of the exercise, the rotary neck muscles produce positive work to lift the resistance weight. When the neck reaches the extreme position on the side opposite the starting position, the subject begins to return the head towards the starting position and again rotates the head smoothly, slowly and gradually during which the rotary neck muscles are producing negative work as the resistance weight descends towards starting position. The exercise is repeated until the subject can no longer produce positive work. The head pads 40 are then retracted away from the head and the head pad assembly is adjusted in the manner described above in order to set the head pads in the proper position for exercising the opposite rotary muscles. In other words, the starting position of this exercise is in the opposite extreme position relative to that of the first exercise described above. In this exercise phase, positive work is performed while the head rotates in a direction opposite to the direction of positive work as performed in the first test described above. It should be understood from the above that oppositely located neck muscles associated with the cervical vertebrae are respectively responsible for rotating the neck in opposite directions about the vertical axis of the vertebrae. Therefore, two such oppositely directed exercise phases are required. During each phase of exercise, the number of repetitions of the head is measured and recorded on a video screen through suitable equipment.

In order to measure the static strength of the rotary neck muscles, the sprocket disc 89 is locked by pin 112 in a plurality of different angular positions determined by the reception of pin 105 in the apertures of sprocket disc 89; and in each angular position, the subject exerts with the rotary muscles a force through the pads 40 tending to rotate pivot shaft 86 which, of course, is held against movement due to the lock pin 112 received in sprocket disc 89. The strain gauge 104 measures the force of the rotary neck muscles in each position while a potentiometer measures the angle of the position. The force and angular position is measured and recorded on a video screen. Having determined the static strength of the rotary neck muscles, the operator may then select an appropriate resistance weight safely less than the static strength, for use in performing the dynamic exercise described above. A comparison of the static strength obtained by tests conducted immediately before and after the dynamic exercise will give valuable information as to the subject's muscle fiber type and the type of rehabilitative exercise needed for the particular subject and other useful information.

Although the methods and apparatus of the invention have been shown and described as being applicable for testing or exercising the neck muscles, certain aspects of the invention may also be applicable to exercising or testing the rotary torso muscles. Therefore, the scope of the invention need not be limited to rotary neck muscles.

What is claimed is:

1. A method of exercising rotary muscles of the neck of a human subject comprising the steps of immobilizing the chest and shoulders of the subject below the neck to isolate the neck muscles from the torso of the subject, positioning the subject's head against a resistance pad movable about a vertical axis, having the subject exert with said muscles a force against the resistance pad to rotate the pad about said vertical axis while the subject rotates the head towards a first side of the subject, and connecting a yieldable resistance weight to the pad to yieldingly oppose movement of said pad toward said first side, and then having the subject rotate his head from said first side towards an opposite second side while said resistance weight returns towards a starting position and wherein said resistance weight is less than the static strength of the subject's neck muscle being exercised and wherein the chest and shoulders of the subject are immobilized by rotating about a vertical axis a pad frame to a position in front of the exerciser, and then moving a chest pad on the frame horizontally to engage chest and shoulder areas of the subject.

2. A method of exercising rotary muscles of the neck of a human subject comprising the steps of immobilizing the subject below the neck with the subject in a seated position against a backrest, positioning the subject's head towards one side of the subject and against a resistance pad movable about a vertical axis, starting from said one side having the subject exert with said muscles a force against the resistance pad to rotate the pad about said vertical axis while the subject rotates the head towards a second side of the subject opposite said one side, and connecting a resistance weight to the pad to yieldingly oppose movement of said pad from said one side toward said second side, and then having the subject rotate his head from said second side towards said one side while said resistance weight returns towards a starting position by gravity, and employing a resistance weight that is less than the static strength of the subject's muscles being exercised and wherein the chest and shoulders of the subject are immobilized by rotating about a vertical axis a pad frame to a position in front of the exerciser, and then moving a chest pad on the frame horizontally to engage chest and shoulder areas of the subject.

* * * * *